US012723850B2

(12) United States Patent
Brune

(10) Patent No.: US 12,723,850 B2
(45) Date of Patent: Sep. 1, 2026

(54) POPPER TARGET SYSTEM

(71) Applicant: Challenge Targets, LLC, Fort Thomas, KY (US)

(72) Inventor: Bradley T. Brune, Fort Thomas, KY (US)

(73) Assignee: Challenge Targets, LLC, Fort Thomas, KY (US)

( * ) Notice: Subject to any disclaimer, the term of this patent is extended or adjusted under 35 U.S.C. 154(b) by 352 days.

(21) Appl. No.: 18/542,859

(22) Filed: Dec. 18, 2023

(65) Prior Publication Data

US 2024/0219155 A1 Jul. 4, 2024

Related U.S. Application Data

(60) Provisional application No. 63/477,424, filed on Dec. 28, 2022.

(51) Int. Cl.
*F41J 7/04* (2006.01)
*F41J 1/10* (2006.01)

(52) U.S. Cl.
CPC .. *F41J 7/04* (2013.01); *F41J 1/10* (2013.01)

(58) Field of Classification Search
CPC ..... F41J 7/04; F41J 1/10
See application file for complete search history.

(56) References Cited

U.S. PATENT DOCUMENTS 1,025,944 A * 5/1912 Elliott ..... F41J 7/04 273/390
2,039,552 A * 5/1936 Reynolds ..... F41J 7/04 273/391
2,805,066 A * 9/1957 Mongello ..... F41J 7/04 60/634
4,330,129 A * 5/1982 Meredith ..... F41J 1/10 273/372
4,917,388 A * 4/1990 Marquardt ..... F41J 7/04 273/392
5,240,258 A * 8/1993 Bateman ..... F41J 1/10 273/392

(Continued)

OTHER PUBLICATIONS

Karl Rehn, Notes from KR, John Pepper's original "Pepper Popper" drawing, https://blog.krtraining.com/john-peppers-oroginal-pepper-drawing, dated Dec. 17, 2020, printed Dec. 7, 2022, 8 pages.

(Continued)

*Primary Examiner* — Dmitry Suhol
(74) *Attorney, Agent, or Firm* — Wood Herron & Evans LLP

(57) ABSTRACT

A falling plate target system has a base having an elongated frame having a length, a forward end, and a rearward end, a target plate pivoted to the base frame and configured to be set in a generally upright position to fall rearwardly to a down position when struck on a front surface thereof, and an extension frame with an impact pad. The extension frame is foldably mounted to the base frame and movable between an extended position and a folded position. The extended position locates the impact pad rearward of the base frame to be contacted by the target plate when it falls to the down position. The impact pad isolates impact forces of the target plate from the base frame.

20 Claims, 6 Drawing Sheets

(56) References Cited

U.S. PATENT DOCUMENTS

| | | | | | |
|---|---|---|---|---|---|
| 5,346,226 | A * | 9/1994 | Block | F41J 7/04 | 273/392 |
| 5,433,451 | A * | 7/1995 | De Vries | F41J 7/04 | 273/392 |
| 5,603,505 | A * | 2/1997 | Acock | F41J 7/06 | 273/391 |
| 5,868,394 | A * | 2/1999 | Garland | F41J 1/10 | 273/386 |
| 5,934,678 | A * | 8/1999 | Theissen | F41J 7/06 | 273/386 |
| 6,779,797 | B1 * | 8/2004 | Chou | F41J 7/04 | 273/391 |
| 11,391,548 | B1 | 7/2022 | Woitas | | |
| 2011/0175293 | A1 * | 7/2011 | Brune | F41J 7/04 | 273/406 |
| 2012/0205870 | A1 * | 8/2012 | Saunders | F41J 7/04 | 273/392 |
| 2014/0284880 | A1 * | 9/2014 | Burks | F41J 1/10 | 273/407 |
| 2016/0327378 | A1 * | 11/2016 | Davis | F41J 7/04 | |
| 2018/0008788 | A1 | 1/2018 | Kamen et al. | | |

OTHER PUBLICATIONS

USPSA/IPSC, Inc., USPSA Competition Rules, National Range Officers Institute, Sep. 2021, Burlington, WA.

* cited by examiner

POPPER TARGET SYSTEM

RELATED APPLICATION

This application claims priority to U.S. Patent Application No. 63/477,424, filed Dec. 28, 2022, and incorporates the same by reference herein.

TECHNICAL FIELD

This invention relates to a shooting reactive target system.

BACKGROUND

Reactive targets are used for fun, training, and competition. In one form, a target plate is made from hardened steel to resist damage from bullets and can move to indicate a "hit." One type of reactive target is known as a "Popper" or "Pepper Popper," named after the original designer, John Pepper. Popper targets are falling targets that are commonly used in shooting competitions and firearms training. The most common design includes a base and a target plate that falls when struck by a bullet.

The falling plate can be used to "activate" another target. To achieve this, a cable or rope is typically mechanically fastened to the plate so the cable is pulled as the plate falls. It is important that the tension of the cable remains consistent after many repetitions of the plate being shot, falling, and being reset.

Thus, it is common for the base of the Popper to be staked to the ground to maintain its position. It is also important that the Popper base stay in the same location during matches so each competitor is shooting the target at the same distance, position and angle.

Because the plates are typically large and heavy (28"-42" tall and usually ⅜" thick steel), the base of the target will typically want to jump and reposition itself when the target plate falls. To keep the base in the same position, ranges typically use ground stakes to secure the base of the target to the ground. Although the ground stakes help, the base of the target and stakes will eventually work themselves loose when the falling plate repeatedly slams against the base. Even a small amount of movement in the location of the base can change the tension of an activator cable and cause a malfunction when trying to activate a second target.

A base with a damping block needs to be between 28" to 42" inches long so the block can catch the tip of an official length plate. The base of these targets is typically made of heavy gauge steel so it does not bend when staking it to the ground. The combination of the thick steel and large dimensions make most bases very heavy and difficult to store.

Others have used a landing pad separate from the base, such as an old tire, to absorb the impact of the plate landing and to hold it off the ground so that it is easier to grip for lifting to the reset position. Ranges sometimes place an old rubber tire behind the target plate so the tip of the plate lands on the tire to dampen the impact and prevent the stakes from working loose. Because the tire is not staked to the ground or connected to the base of the target, a smaller tire will often move and need to be repeatedly repositioned during a match so it is properly aligned with the falling plate.

SUMMARY OF THE INVENTION

In one aspect, a falling plate target system comprises a base having an elongated frame having a length, a forward end, and a rearward end, a target plate pivoted to the base frame and configured to be set in a generally upright position to fall rearwardly to a down position when struck on a front surface thereof, and an extension frame with an impact pad, the extension frame foldably mounted to the base frame and movable between an extended position and a folded position, the extended position locating the impact pad rearward of the base frame to be contacted by the target plate when it falls to the down position, the impact pad isolating impact forces of the target plate from the base frame.

The base frame and extension frame can be configured such that in the folded position the impact pad is positioned between the forward and rearward ends of the base frame. The base frame and extension frame can be configured such that in the folded position the impact pad is positioned forward of the forward end of the base frame.

The extension frame can be fabricated of rod that is formed into a generally rectangular configuration, the extension frame having inwardly bent ends, the extension frame having a first length, the base frame can have a pair of side walls with a first pair of opposite openings in the side walls near the rearward end of the base frame, and the inwardly bent ends of the extension frame can be pivotally received in the first pair of opposite openings in the side walls of the base frame. In the folded position the impact pad is positioned between the side walls of the base frame and between the forward and rearward ends of the base frame.

A second pair of opposite openings can be included in the side walls of the base frame near the forward end of the base frame, whereby the inwardly bent ends of an extension frame of a second length, longer than the first length, can be positioned in the second pair of opposite openings such that the impact pad is positioned rearward of the rearward end of the base frame and closely adjacent thereto.

The base frame can have a pair of side walls with a pair of opposite keyhole-shaped notches in the side walls located closer to the forward end of the base frame than the rearward end of the base frame, the notches having an upper narrower portion and a lower wider portion, the target plate can have a pair of outwardly extending trunnions on a lower end thereof that are received in the notches, the trunnions configured such that they can be inserted into and removed from the notches when the target plate is in the generally upright position but cannot be removed from the notches when the target plate is in the down position.

The side walls of the base frame can have a pair of opposite openings positioned below and forward of the opposite keyhole-shaped notches, whereby a locking rod can be positioned in the pair of opposite openings to lock the target plate in the generally upright position. The base frame can include stake down tabs to stake the base frame to the ground.

In another aspect, a falling plate target system comprises a base having an elongated frame having a length, a forward end, and a rearward end, a target plate pivoted to the base frame and configured to be set in a generally upright position to fall rearwardly to a down position when struck on a front surface thereof, an arm having a first end pivoted to the base frame and a second free end, the arm positioned rearward of the target plate to be moved when the target plate falls and contacts the arm, an actuation cable operably attached to a portion of the free end of the arm, movement of the arm by the falling target plate causing the actuation cable to be pulled, and a covered actuation cable passageway on the base frame, the passageway having a first end adjacent the forward end of the base frame and a second end rearward of the target plate, the actuation cable passing through the passageway, the passageway protecting the actuation cable from damage.

The passageway can be a tube.

The base frame can have a side wall and the arm can be pivoted to the side wall of the base frame.

In another aspect, a falling plate target system comprises a base having an elongated frame having a length, a forward end, and a rearward end, a target plate pivoted to the base frame and configured to be set in a generally upright position to fall rearwardly to a down position when struck on a front surface thereof, an extension frame with an impact pad, the extension frame foldably mounted to the base frame and movable between an extended position and a folded position, the extended position locating the impact pad rearward of the base frame to be contacted by the target plate when it falls to the down position, the impact pad isolating impact forces of the target plate from the base frame, an arm having a first end pivoted to the base frame and a second free end, the arm positioned rearward of the target plate to be moved when the target plate falls and contacts the arm, an actuation cable operably attached to a portion of the free end of the arm, movement of the arm by the falling target plate causing the actuation cable to be pulled, and a covered actuation cable passageway on the base frame, the passageway having a first end adjacent the forward end of the base frame and a second end rearward of the target plate, the actuation cable passing through the passageway, the passageway protecting the actuation cable from damage.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
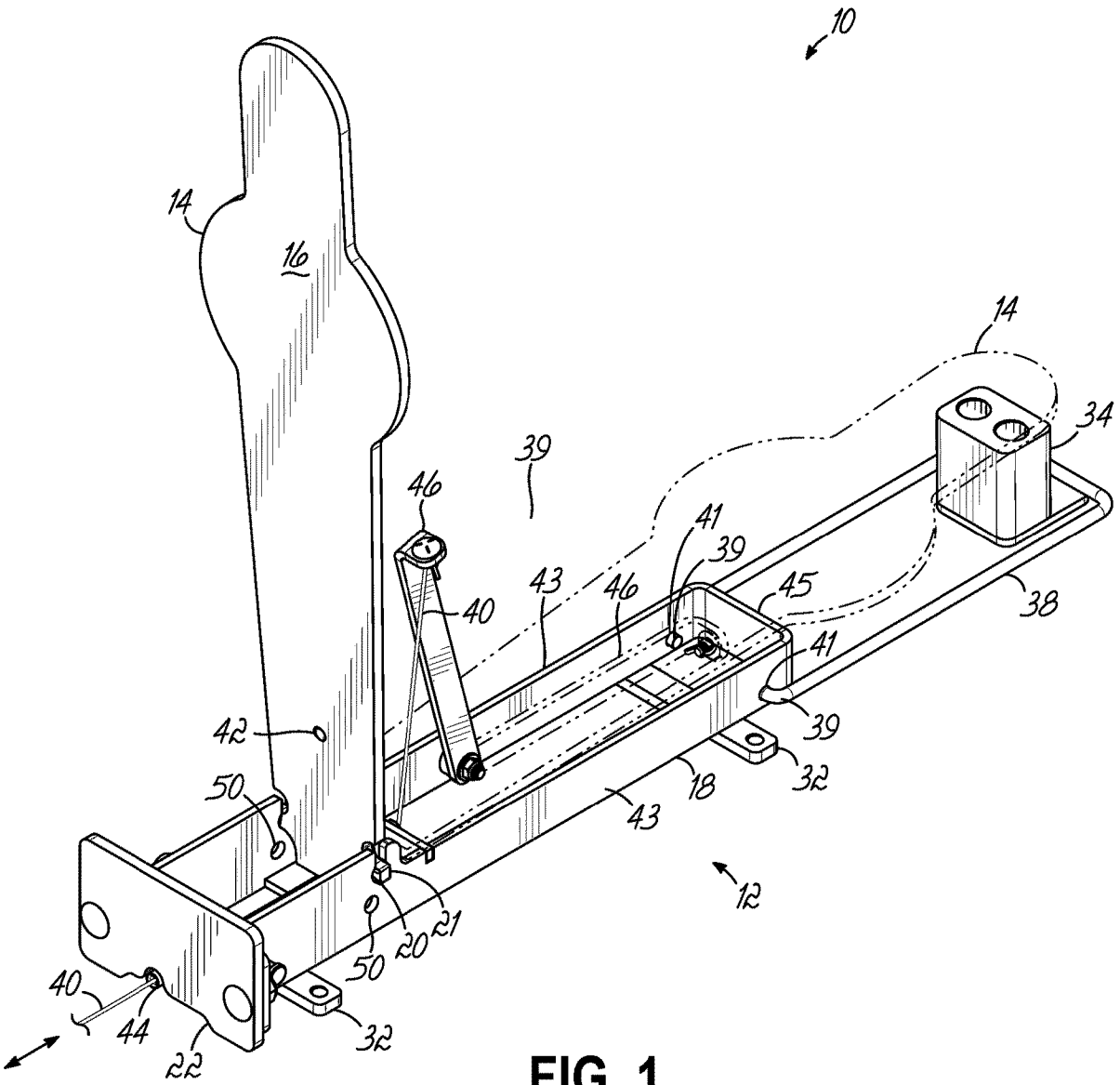
FIG. 1 is a front isometric view of a target system according to one embodiment of the present invention.
Figure 2:
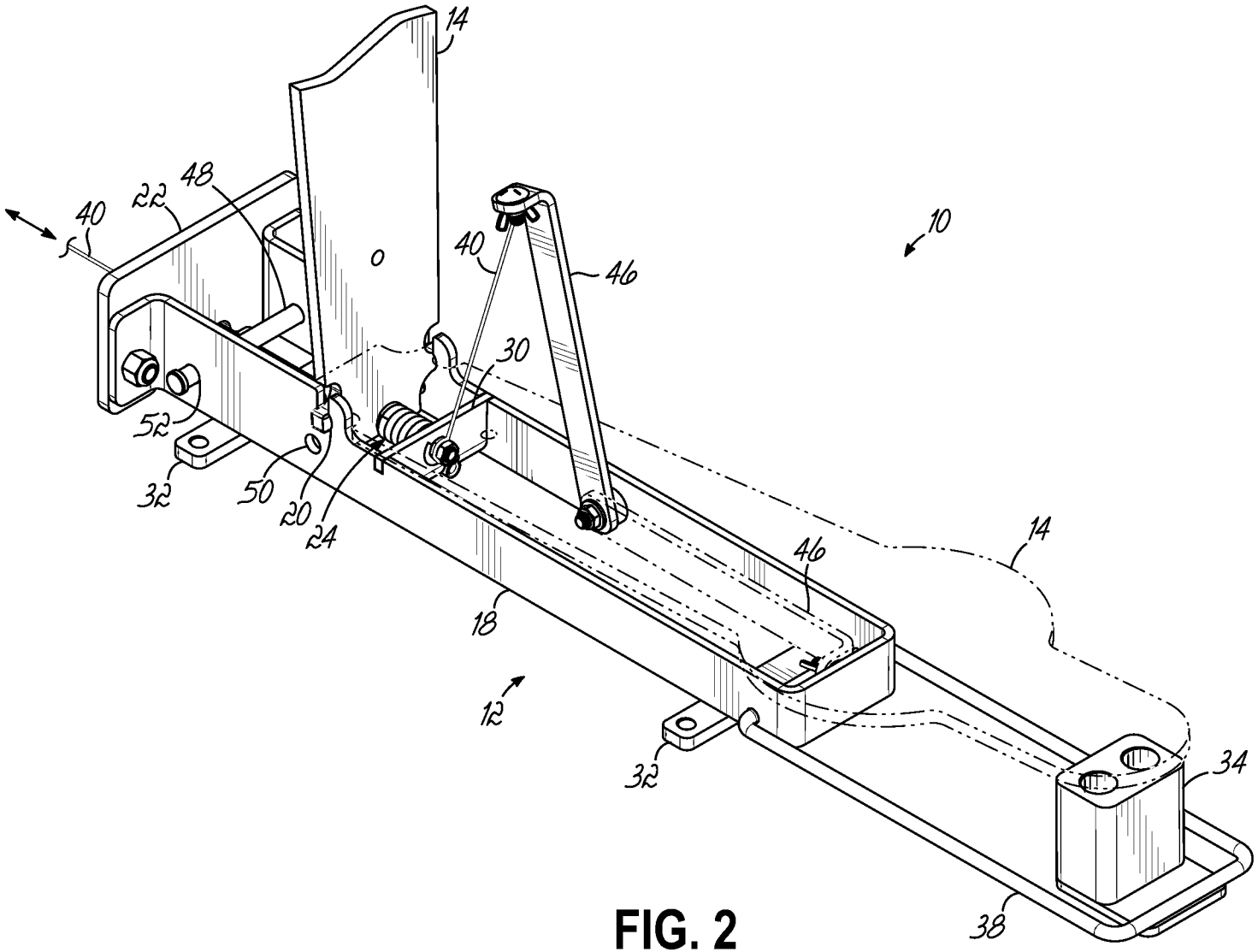
FIG. 2 is a rear isometric view thereof.
Figure 3:
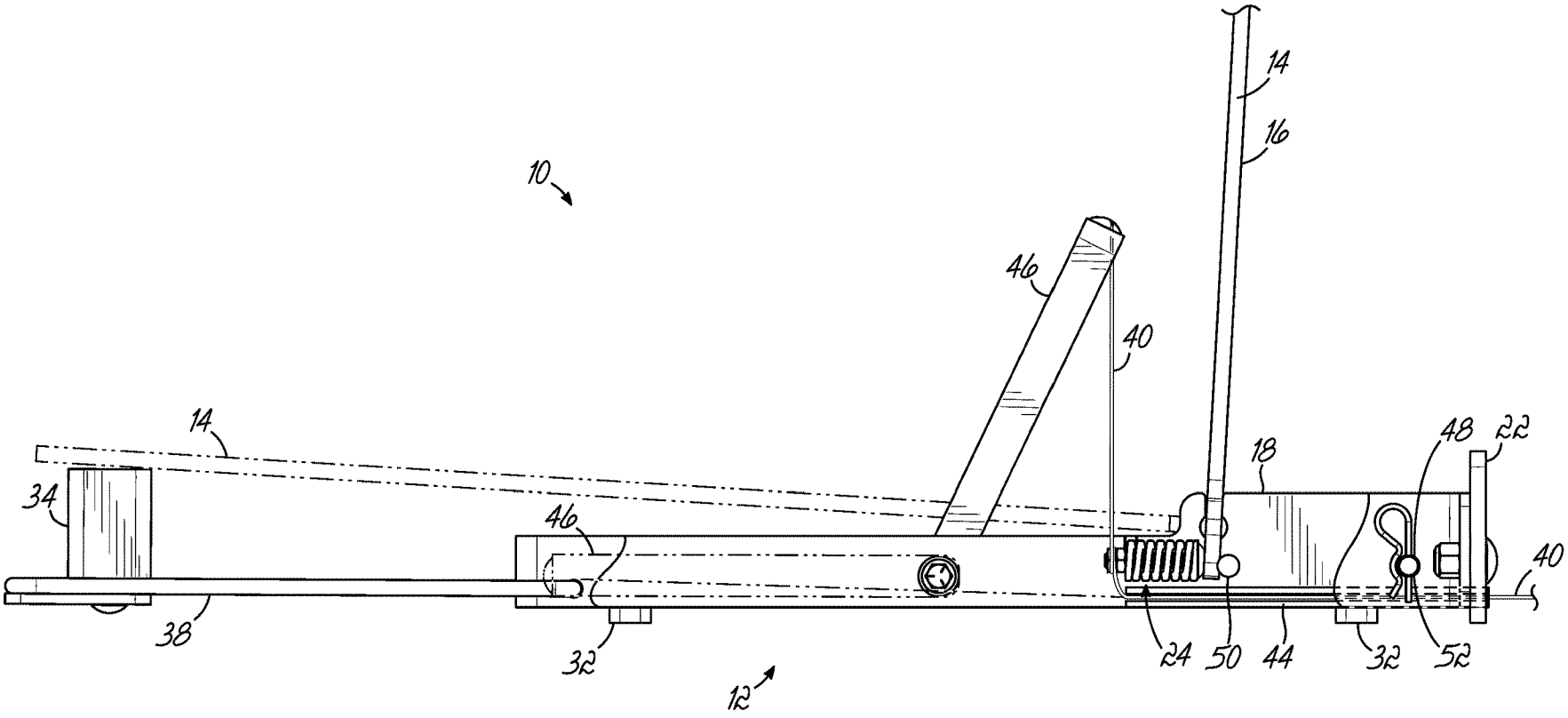
FIG. 3 is side, partially cut-away view thereof showing a target actuating feature.
Figure 4:
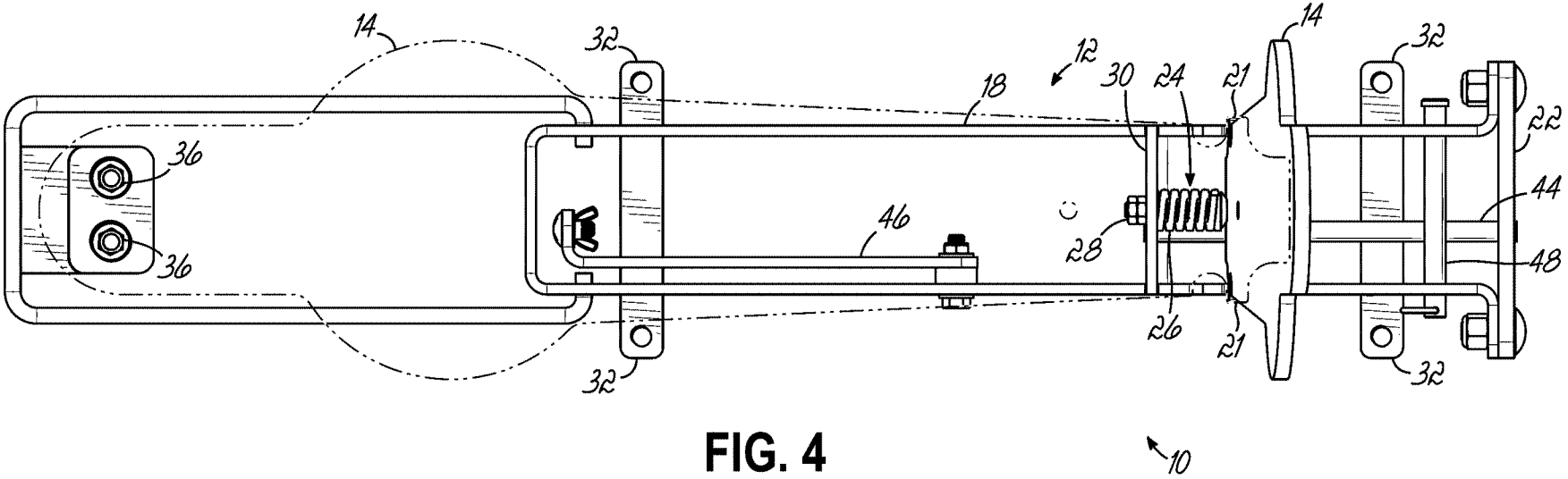
FIG. 4 is a top view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction toward the shooter and the direction from which projectiles are fired, while "rearward" will indicate the opposite direction. "Lateral" or "transverse" indicates a side-to-side direction generally perpendicular to the axis of the base or target plate.

Referring first to FIGS. 1-4, therein is shown a "Popper" falling target system 10 according to one embodiment of the present invention. The system includes a base 12 that supports a target plate 14 that is pivotally supported by the base 12. When the front face 16 of the upright plate 14 is struck by a bullet, the impact causes the plate 14 to fall backward to the "down" position (shown in phantom lines in FIGS. 1-4). The plate 14 can then be reset to the upright ("set") position for the next shooter/competitor.

The base 12 includes a frame 18 which may be in the general form of an elongated open-topped box. The target plate 14 is pivotally carried by the frame 18 in opposite notches 20 which provide pivot points for trunnions 21 on the plate 14. Typically, the target plate 14 is made of hardened steel to resist the impact of bullets and the frame 18 can be made of mild steel. A shield panel 22 made of hardened steel can be provided at the forward end of the frame 18.

The plate 14 is easily separated from the base 12 for replacement, storage, or transport. The notches 20 in the frame 18 can be a keyhole shape that is narrower above the pivot point so the trunnions 21 on the plate 14 can be easily separated from the base 12 when the plate 14 is in the vertical position, but are secure and cannot be separated from the base when the plate 14 is in the "down" position (shown in phantom lines in FIGS. 1-4). This allows the plate 14 to be easily separated from the base 12 for replacement, storage, or transport but prevents the plate 14 from disengaging from the frame 18 when it falls, which would make resetting the target much more difficult.

Typically, when set to the upright position, the plate 14 is angled slightly forward from exactly vertical. This helps reduces the chance of the plate 14 falling inadvertently and deflects the impacting bullet in a safe, downward direction. The angle and "bounce" of the target plate 14 can be changed by adjusting the tension on a position spring mechanism 24. The tension spring mechanism 24 can include a compression spring 26 mounted to a bulkhead 30 in the frame 18 with an adjustable threaded fastener 28. The mechanism 24 contacts the plate 14 below its pivot axis.

It is important that the base 12 does not move while being used. Stake down tabs 32 can be provided in order to secure the base 12 to the ground with stakes (not shown) or some other fastener. A base with a damping block needs to be between 28" to 42" inches long so the rubber block can catch the tip of an official length plate. The base of these targets is typically made of thick gauge steel so it doesn't bend when staking it to the ground. The combination of the thick steel and large dimensions make most bases very heavy and difficult to store.

The present system 10 includes a damping block pad 34 against which the target plate 14 lands when it falls to the rear after being struck by a bullet. In the illustrated embodiment, the impact pad 34 includes a rubber block that is attached with threaded fasteners 36 to a skeletal frame 38. The skeletal frame 38 is pivotally carried by the base frame 18. This pivotal attachment isolates impact/shock forces and vibration of the falling plate 14 from the base 12. This isolation of impact/shock forces helps prevent movement of the base 12 and loosening of the base's attachment to the ground as the system 10 is being used. The skeletal frame 38 can be fabricated of heavy gauge wire, or rod stock, or bar stock (all three generically embraced by the term "rod"), preferably having a circular cross-section, that is formed into a generally rectangular configuration and that has inwardly bent ends 39 that are pivotally received in opposite openings 41 in side walls 43 of the base 12 near the rearward end 45 of the base 12.

In certain types of competition or shooting practice, the movement of the falling target plate can be used to actuate a secondary target (not shown). This actuation is accomplished by pulling a cable 40 that was traditionally secured to an opening 42 or connector on the face 16 of the target plate 14. This prior arrangement exposes a cable to potential damage by bullet impact and by spall from fragmenting bullets that hit the target plate and ricochet downward. The hardware is exposed to direct bullet hits on the face of the target and will often break and need to be replaced during matches. The hardware loosens from the vibration caused by bullet impacts on the plate. This means the hardware has to be tightened and the cable tension needs to be adjusted regularly. The hardware mounting point on the face of the target plate can cause bullet fragments to splash back and hit the shooter. To get the proper leverage (and pull length) with this set-up, the mounting point and cable need to be about 6-7" up from the bottom of the target plate. On a smaller target plate, the cable is more likely to take a direct hit which can break it in one shot.

Another disclosed feature provides an apparatus for protecting the actuation cable 40 from such damage. A tubular passage 44 can be fixed to the frame 18 with an open forward end and a rearward end that opens behind the position of the target plate 14. The actuation cable 40 can pass through this tube 44 and then attach to a pivotal arm 46 mounted on the frame 18. The target plate 14 protects the cable 40 and arm 46, which are positioned behind it, and the tube 44 protects the cable 40 from the impact of spall from bullets hitting the face 16 of the target plate 14. When the target plate 14 falls, it contacts and moves the arm 46, which pulls on the cable 40 to actuate a secondary target. Vibration from the bullet strikes will not loosen the hardware or change the tension on the cable 40.

Figure 7:
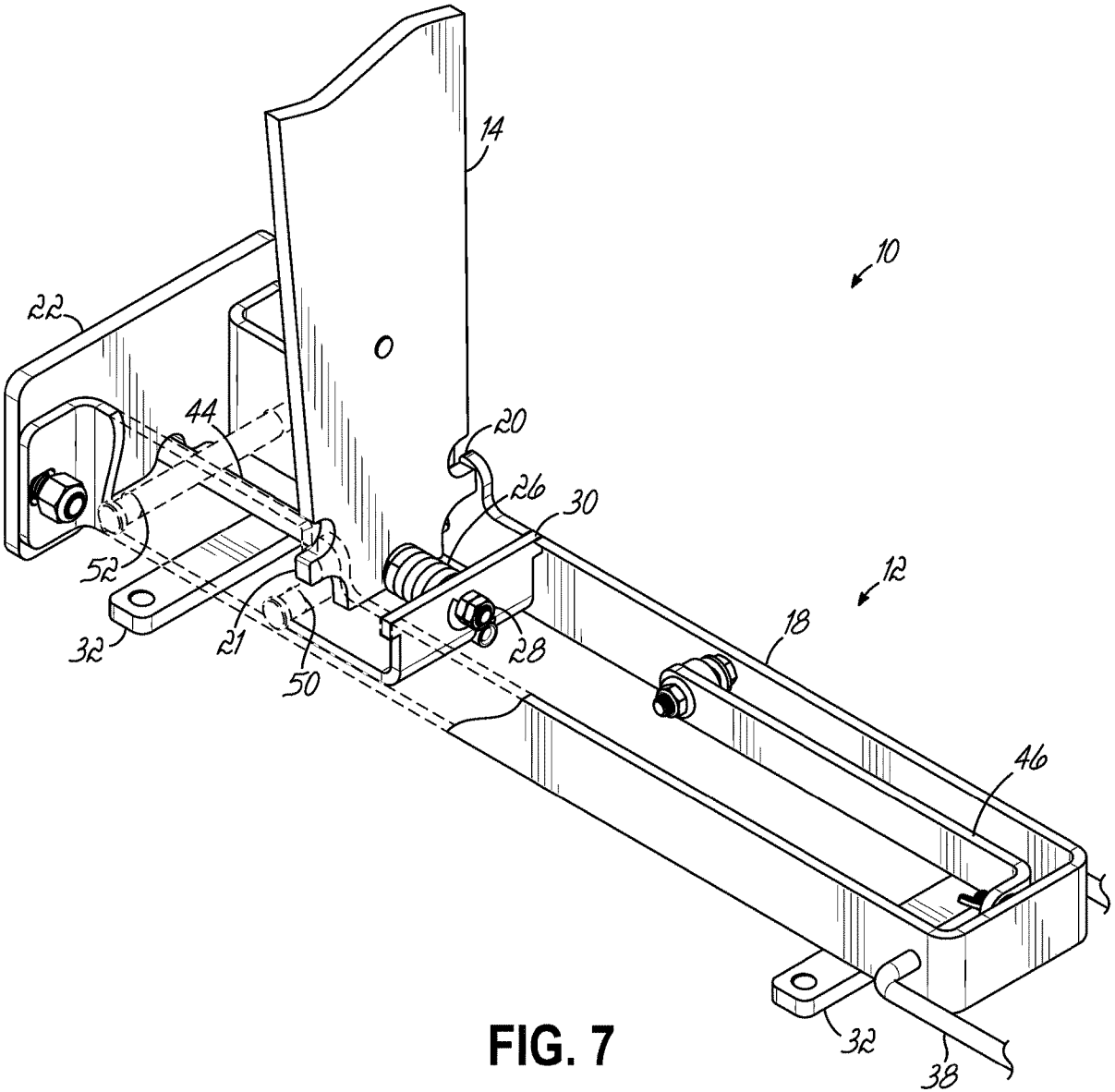
FIG. 7 is a rear isometric, partially cut-away view showing a target holding an actuating feature.

The target system 10 can easily accommodate target plates 14 of different sizes, shapes, and lengths. As shown in FIG. 7, the target plate 14 also can be locked in an upright position by a locking or blocking bar, rod, or pin 48 passing through opposite openings 50 in the frame 18 forward of the lower end of the target plate 14 and below its pivot axis. The bar 48 can be stored at an inert position in opposite storage openings 52 elsewhere on the frame 18, such as at a forward location behind the protective shield 22.

Figure 5:
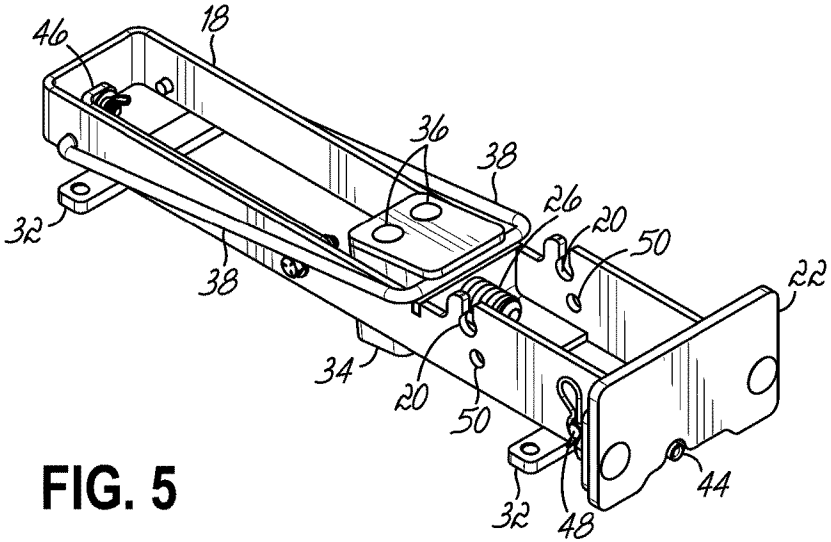
FIG. 5 is an isometric view in a folded condition with the target panel removed.
Figure 6:
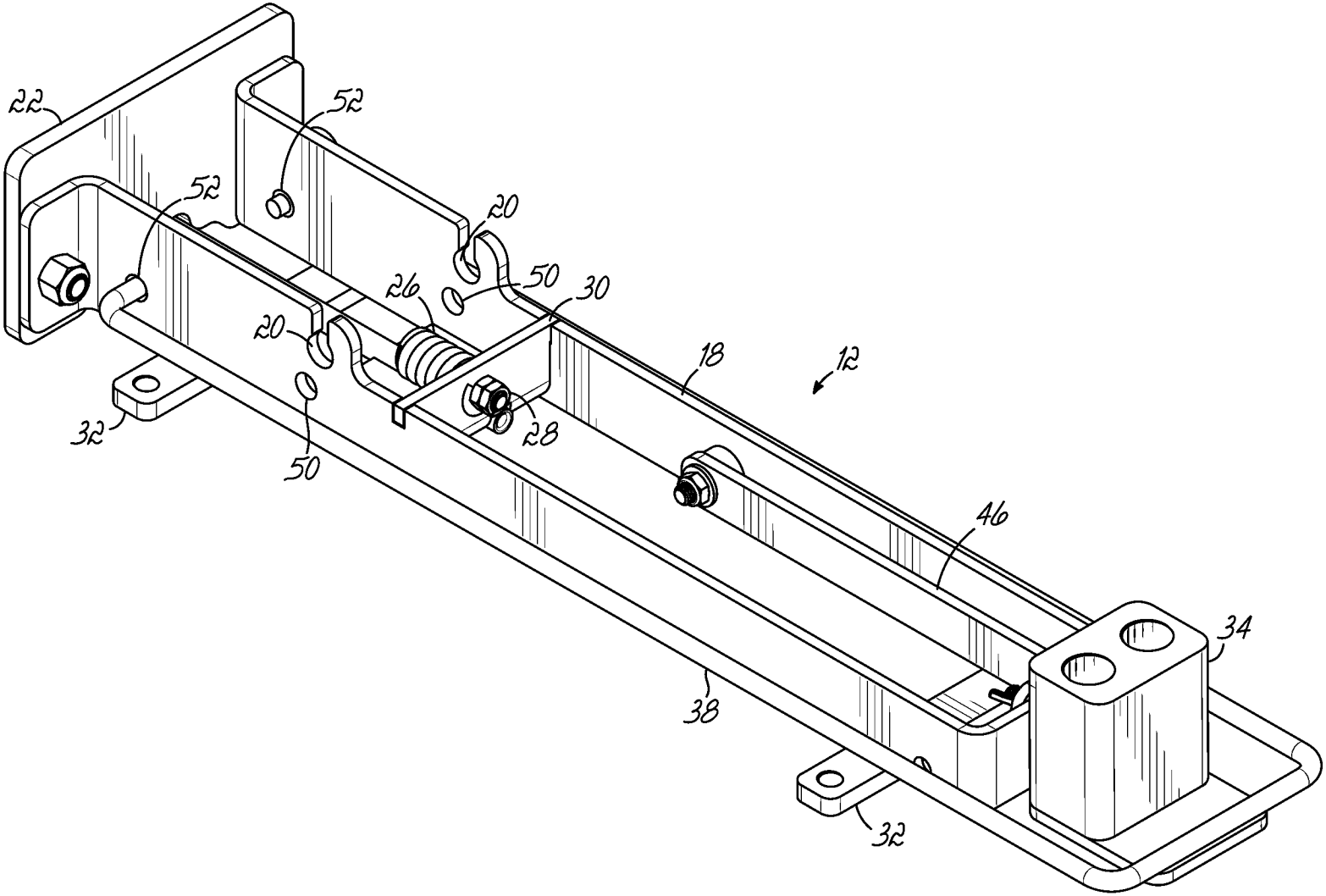
FIG. 6 is an isometric view showing an alternate transport/storage position.

Referring now to FIG. 5, the target plate 14 can be removed from the base 12 and the impact block 34 and skeletal frame 38 folded into the base frame 18 in order to reduce the size of the base 12 for storage and transport without separating it from the base 12. This pivot also isolates the base 12 and frame 18 from the impact shocks of the heavy target plate 14 landing on the impact block 34, as mentioned above. When used with longer (e.g., 43 inch) target plates, the skeletal frame 38 can be made longer to position the impact block 34 further to the rear of the frame 18. In such embodiments, the folded skeletal frame 38 will then position the impact block 34 forward of the shield panel 22. Or, as shown in FIG. 6, the legs of the skeletal frame 38 can be sprung apart and repositioned to alternate openings in the frame 18, such as the forward storage openings 52, without use of tools.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A falling plate target system, comprising:

a base having an elongated frame having a length, a forward end, and a rearward end, a target plate pivoted to the base frame and configured to be set in a generally upright position to fall rearwardly to a down position when struck on a front surface thereof, and an extension frame with an impact pad, the extension frame foldably mounted to the base frame and movable between an extended position and a folded position, the extended position locating the impact pad rearward of the base frame to be contacted by the target plate when it falls to the down position, the impact pad isolating impact forces of the target plate from the base frame, wherein:

the extension frame is fabricated of rod that is formed into a generally rectangular configuration, the extension frame having inwardly bent ends, the extension frame having a first length, the base frame has a pair of side walls with a first pair of opposite openings in the side walls near the rearward end of the base frame, and the inwardly bent ends of the extension frame are pivotally received in the first pair of opposite openings in the side walls of the base frame, and wherein in the folded position the impact pad is positioned between the side walls of the base frame and between the forward and rearward ends of the base frame.

2. The target system of claim 1, wherein the base frame and extension frame are configured such that in the folded position the impact pad is positioned between the forward and rearward ends of the base frame.

3. The target system of claim 1, wherein the base frame and extension frame are configured such that in the folded position the impact pad is positioned forward of the forward end of the base frame.

4. The target system of claim 1, further including a second pair of opposite openings in the side walls of the base frame near the forward end of the base frame, whereby the inwardly bent ends of an extension frame of a second length, longer than the first length, are positioned in the second pair of opposite openings the impact pad is positioned rearward of the rearward end of the base frame and closely adjacent thereto.

5. The target system of claim 1, wherein:

the base frame has a pair of side walls with a pair of opposite keyhole-shaped notches in the side walls located closer to the forward end of the base frame than the rearward end of the base frame, the notches having an upper narrower portion and a lower wider portion, the target plate has a pair of outwardly extending trunnions on a lower end thereof that are received in the notches, the trunnions configured such that they can be inserted into and removed from the notches when the target plate is in the generally upright position but cannot be removed from the notches when the target plate is in the down position.

6. The target system of claim 5, wherein the side walls of the base frame have a pair of opposite openings positioned below and forward of the opposite keyhole-shaped notches, whereby a locking rod can be positioned in the pair of opposite openings to lock the target plate in the generally upright position.

7. The target system of claim 1, wherein the base frame includes stake down tabs to stake the base frame to the ground.

8. A falling plate target system, comprising:

a base having an elongated frame having a length, a forward end, and a rearward end, a target plate pivoted to the base frame and configured to be set in a generally upright position to fall rearwardly to a down position when struck on a front surface thereof, an arm having a first end pivoted to the base frame and a second free end, the arm positioned rearward of the target plate to be moved when the target plate falls and contacts the arm, an actuation cable operably attached to a portion of the free end of the arm, movement of the arm by the falling target plate causing the actuation cable to be pulled, and a covered actuation cable passageway on the base frame, the passageway having a first end adjacent the forward end of the base frame and a second end rearward of the target plate, the actuation cable passing through the passageway, the passageway protecting the actuation cable from damage.

9. The target system of claim 8, wherein the passageway is a tube.

10. The target system of claim 8, wherein the base frame has a side wall and the arm is pivoted to the side wall of the base frame.

11. A falling plate target system, comprising:

a base having an elongated frame having a length, a forward end, and a rearward end, a target plate pivoted to the base frame and configured to be set in a generally upright position to fall rearwardly to a down position when struck on a front surface thereof, an extension frame with an impact pad, the extension frame foldably mounted to the base frame and movable between an extended position and a folded position, the extended position locating the impact pad rearward of the base frame to be contacted by the target plate when it falls to the down position, the impact pad isolating impact forces of the target plate from the base frame, an arm having a first end pivoted to the base frame and a second free end, the arm positioned rearward of the target plate to be moved when the target plate falls and contacts the arm, an actuation cable operably attached to a portion of the free end of the arm, movement of the arm by the falling target plate causing the actuation cable to be pulled, and a covered actuation cable passageway on the base frame, the passageway having a first end adjacent the forward end of the base frame and a second end rearward of the target plate, the actuation cable passing through the passageway, the passageway protecting the actuation cable from damage.

12. The target system of claim 11, wherein the base frame and extension frame are configured such that in the folded position the impact pad is positioned between the forward and rearward ends of the base frame.

13. The target system of claim 11, wherein the base frame and extension frame are configured such that in the folded position the impact pad is positioned forward of the forward end of the base frame.

14. The target system of claim 11, wherein:

the extension frame is fabricated of rod that is formed into a generally rectangular configuration, the extension frame having inwardly bent ends, the extension frame having a first length;

the base frame has a pair of side walls with a first pair of opposite openings in the side walls near the rearward end of the base frame; and the inwardly bent ends of the extension frame are pivotally received in the first pair of opposite openings in the side walls of the base frame;

wherein in the folded position the impact pad is positioned between the side walls of the base frame and between the forward and rearward ends of the base frame.

15. The target system of claim 14, further including a second pair of opposite openings in the side walls of the base frame near the forward end of the base frame, whereby the inwardly bent ends of an extension frame of a second length, longer than the first length, are positioned in the second pair of opposite openings the impact pad is positioned rearward of the rearward end of the base frame and closely adjacent thereto.

16. The target system of claim 11, wherein:

the base frame has a pair of side walls with a pair of opposite keyhole-shaped notches in the side walls located closer to the forward end of the base frame than the rearward end of the base frame, the notches having an upper narrower portion and a lower wider portion;

the target plate has a pair of outwardly extending trunnions on a lower end thereof that are received in the notches, the trunnions configured such that they can be inserted into and removed from the notches when the target plate is in the generally upright position but cannot be removed from the notches when the target plate is in the down position.

17. The target system of claim 16, wherein the side walls of the base frame have a pair of opposite openings positioned below and forward of the opposite keyhole-shaped notches, whereby a locking rod can be positioned in the pair of opposite openings to lock the target plate in the generally upright position.

18. The target system of claim 11, wherein the base frame includes stake down tabs to stake the base frame to the ground.

19. The target system of claim 11, wherein the passageway is a tube.

20. The target system of claim 11, wherein the base frame has a side wall and the arm is pivoted to the side wall of the base frame.

* * * * *